US005678528A

United States Patent [19]

Hadley

[11] Patent Number: 5,678,528

[45] Date of Patent: Oct. 21, 1997

[54] BOW WITH BARREL ARRANGEMENT

[76] Inventor: Claude Hadley, 606 Bream St., Mobile, Ala. 36502

[21] Appl. No.: 474,702

[22] Filed: Jun. 7, 1995

[51] Int. Cl.[6] ..... F41B 7/00

[52] U.S. Cl. ..... 124/25; 124/24.1; 124/25.5; 124/27

[58] Field of Search ..... 124/24.1, 65, 66, 124/25, 25.5, 25.6, 25.7, 26, 27

[56] References Cited

U.S. PATENT DOCUMENTS

| | | | |
|---|---|---|---|
| 2,214,224 | 9/1940 | Douglas | 124/24.1 X |
| 2,313,803 | 3/1943 | Carlson | 124/25 |
| 2,757,657 | 9/1956 | Lohmeyer | 124/24.1 X |
| 2,995,128 | 9/1961 | Hornbostel | 124/22 X |
| 3,561,418 | 2/1971 | Fredrickson | 124/24.1 |
| 3,561,419 | 2/1971 | Cucuzza, Sr. | 124/25 |
| 3,572,311 | 3/1971 | Baer | 124/24.1 X |
| 3,895,621 | 7/1975 | Kellogg | 124/24.1 |
| 3,916,867 | 11/1975 | Marshall | 124/41.1 X |
| 4,146,009 | 3/1979 | Adams | 124/44.1 X |
| 4,291,664 | 9/1981 | Nishioka | 124/44.5 |
| 4,385,618 | 5/1983 | Nishioka | 124/24.1 |
| 4,446,844 | 5/1984 | Nishioka | 124/44.5 |
| 4,662,345 | 5/1987 | Stephens | 124/25 |
| 4,688,539 | 8/1987 | Lawrence | 124/37 X |
| 4,696,281 | 9/1987 | Nishioka | 124/25 |
| 4,708,341 | 11/1987 | Paraskevakos | 124/24.1 X |
| 4,829,974 | 5/1989 | Anderson | 124/24.1 |
| 4,957,093 | 9/1990 | Hamlett | 124/24.1 |
| 4,976,250 | 12/1990 | Jeffrey | 124/25 |

*Primary Examiner*—Randolph A. Reese
*Assistant Examiner*—Thomas A. Beach
*Attorney, Agent, or Firm*—Gregory Friedlander

[57] ABSTRACT

A projectile launcher having a barrel for holding projectiles traveling through an aligning opening in or connected to a rigid support. Two bow arms extend from the rigid support. A bow string travels between the ends of the two bow arms and behind the aligning opening. The rigid support may include a brace which extends from the rigid support to the forearm of the user. A piston within the barrel or the barrel itself is propelled by the string. The piston moves relative to the rigid support which remains substantially motionless when used. This bow may have an arm brace characteristic of a wrist slingshot or other bow designs. Pulleys or cams of novel design having curved lips are attached to either bow arm to decrease wear on the bow strings. A novel pulley arrangement is disclosed which limits the number of strings passing behind the rigid support. Tubing or elastic bands may run between the rigid support and bowstring to (1) give additional power to the bow and (2) to keep the bow string travel in line in conjunction with the tubular aligning opening in the rigid support.

5 Claims, 11 Drawing Sheets

BOW WITH BARREL ARRANGEMENT

BACKGROUND OF INVENTION

1. Prior Art

This invention applies to projectile hurdling devices. More particularly the invention applies to bows and sling shots.

| | |
|---|---|
| U.S. Pat. No. 1,781,630 | COMBINATION SLING SHOT AND BOW, E.S. Smith, Inventor April 13,1929 |
| U.S. Pat. No. 3,108,583 | PROJECTILE LAUNCHER, Andis, Inventor, April 13,1959 |
| U.S. Pat. No. 4,050,438 | SPRING TYPE PROJECTING DEVICE Proftenhauer, Inventor July 14, 1976 |
| U.S. Pat. No. 4,169,453 | COMPOUND SLINGSHOT Hunsicker, Inventor, October 3, 1977 |
| U.S. Pat. No. 4,651,707 | MECHANICAL PROJECTOR WITH VARIABLE LEVERAGE ARRANGEMENT Bozek, Inventor June 30, 1986 |
| U.S. Pat. No. 5,016,601 | SLINGSHOT WITH ADJUSTABLE SIGHT Ferguson; Hanz; Moeller, Inventors September 12, 1989 |
| U.S. Pat. No. 5,125,388 | COMPOUND SPEAR SLING M. Nicely; S. Nicely, Inventors October 31, 1990 |
| U.S. Pat. No. 5,247,920 | TOY BOW Harbin, inventor August 18, 1992 |
| U.S. Pat. No. 4,478,203 | COMPOUND BOW CABLE AND BOWSTRING ATTACHMENT MEANS Hayes, Gerald October 23, 1984 |

2. Related Art

The prior art shows compound arms used for sling shots. The prior art shows a bow arm used in combination with a sling shot design, but does not disclose prior art showing a compound bow in combination with a sling shot design having the characteristics of the present invention. The prior art broadly claims the compound slingshot with bow arms and a wrist attachment (no known patent has been found to disclose this, however).

The prior art includes cross bow elements that define a stock. The stock is fitted with a barrel to receive an arrow as in U.S. Pat. No. 3,108,583 to Andis.

Other similar prior art is shown in U.S. Pat. No. 4,651,707 to Bozek showing a slingshot equipped with pivoting arms and U.S. Pat. No. 4,169,453 to Hunsicker which shows a compound slingshot.

GENERAL DISCUSSION OF THE INVENTION

The present invention is a compound slingshot having a rigid support from which extends two rigid arms which each hold a bow arm. The rigid support defines or serves as mounting for a tubular aligning opening which acts as a guide for a barrel which passes through the aligning opening. A first bow arm is mounted on the first rigid arm and a second bow arm is mounted on the second rigid arm. The bow string travels between the ends of the two bow arms and through a space defined between the two rigid arms behind the aligning opening where the bow string attaches to the barrel itself or to a piston which travels within the barrel.

The present invention combines the following elements: (1) a flexing bow arm, (2) a compounding pulley system and (3) a sliding barrel mechanism. One another improvement in the preferred embodiment is a wrist attachment. The rigid support may be designed to be gripped by the hand of the user. It may have a wrist support attached that acts to brace the rigid arm against the forearm of the user. In this way a bow having many characteristics of a slingshot and some characteristics of a rifle is described.

Another improvement is a unique cam design which prevents wear of the string as it moves out of the cam. This cam is improved by having curved outer lips or outer walls of the cam. Pulleys or cams increase the power available from the bow. Because the string is forced into contact with the edges of the cams in this embodiment, the cams have been modified to curve (either outward or inward) to provide a smooth surface for the bow string.

A unique guiding mechanism is disclosed utilizing a tubular aligning opening in conjunction with elastic tubing means to direct the travel of the bow string. A novel arrangement of elastic bands has been added to control the movement of the string in one embodiment.

A novel pulley arrangement is disclosed which limits the number of times the strings cross.

It is, therefore, one purpose of this invention to provide a combination slingshot.

It is a further purpose to provide a combination of the type described for hurling arrows by providing a runner or barrel that can contain either arrows or projectiles.

It is a further object of this invention to provide additional force to the projectile launcher by having a compounding mechanism similar to that used with other bows to strengthen the force available. It is a further object to provide a compounding arrangement of pulleys which reduces the number of times the string passes behind the rigid support.

It is a further object of the invention to add stability to the arrangement by running abrace from the rigid member gripped by the user to the forearm of the user.

It is a further object of the invention to add force and directional control travel utilizing an elastic bond means.

These and other objects and advantages of the invention will become better understood from a consideration of the specification with reference to the accompanying drawings forming part thereof, and in which like numerals correspond to parts throughout the several views of the invention.

BRIEF DESCRIPTION OF THE DRAWINGS

For a further understanding of the nature and objects of the present invention, reference should be made to the following detailed description taken with the accompanying drawings in which like parts am given like reference numerals and wherein:

FIG. 2 is an alternate embodiment showing a single line and curved cams.

DETAILED DISCUSSION OF THE PREFERRED EMBODIMENT(S)

Figure 1:
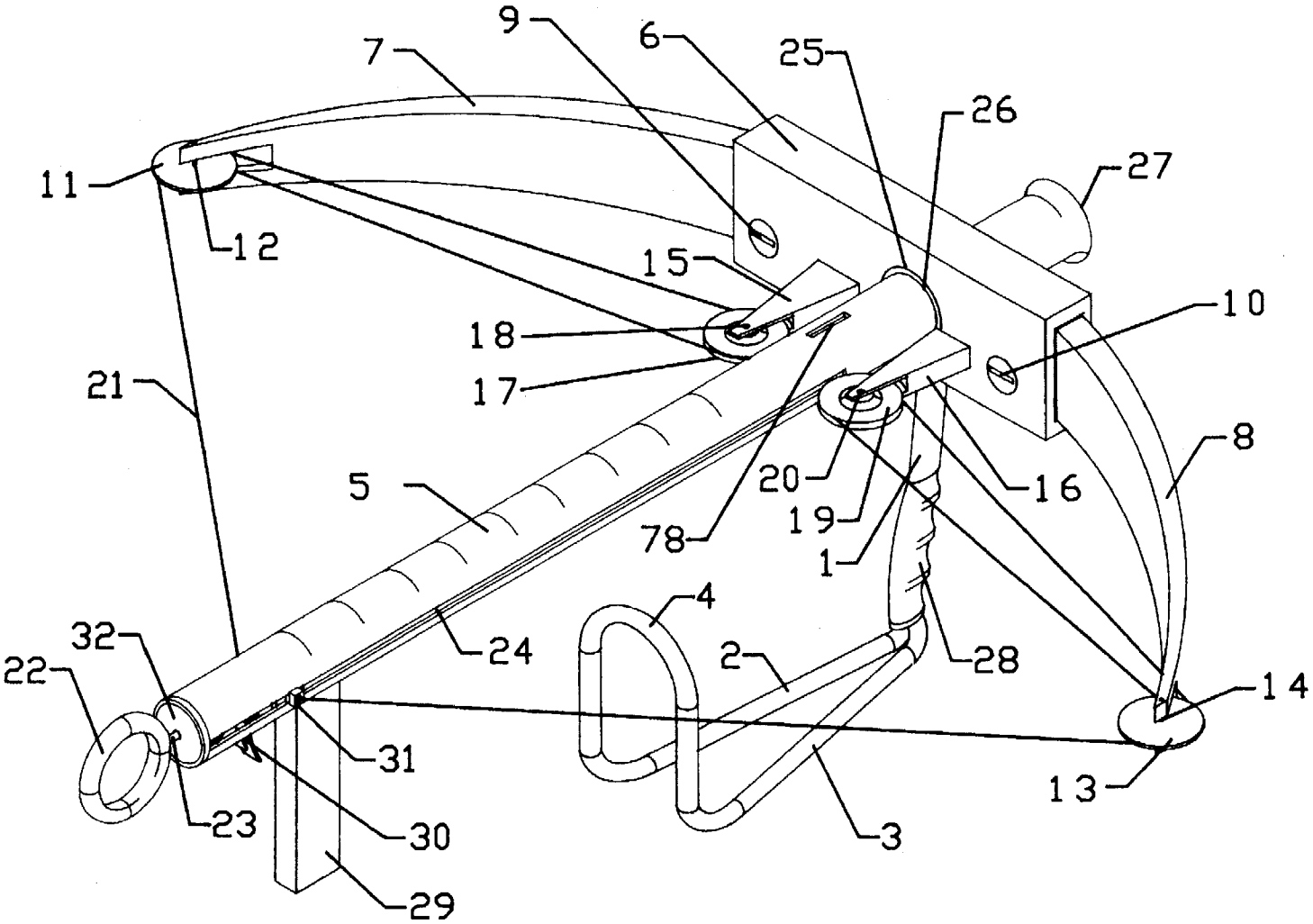
FIG. 1 is a plan view of the invention.

Referring to FIG. 1, of the preferred embodiment, the invention comprises a rigid support 1 having a longitudinal extending grip 28 gripped by the user. The support 1 has two substantially rigid arms, a first grip arm 2 and a second grip arm 3, extending from the grip 28.

A forearm support bar 4 passes over the forearm of the user between the first grip arm 2 and second grip arm 3 when the grip 28 is held by the user.

Figure 2:
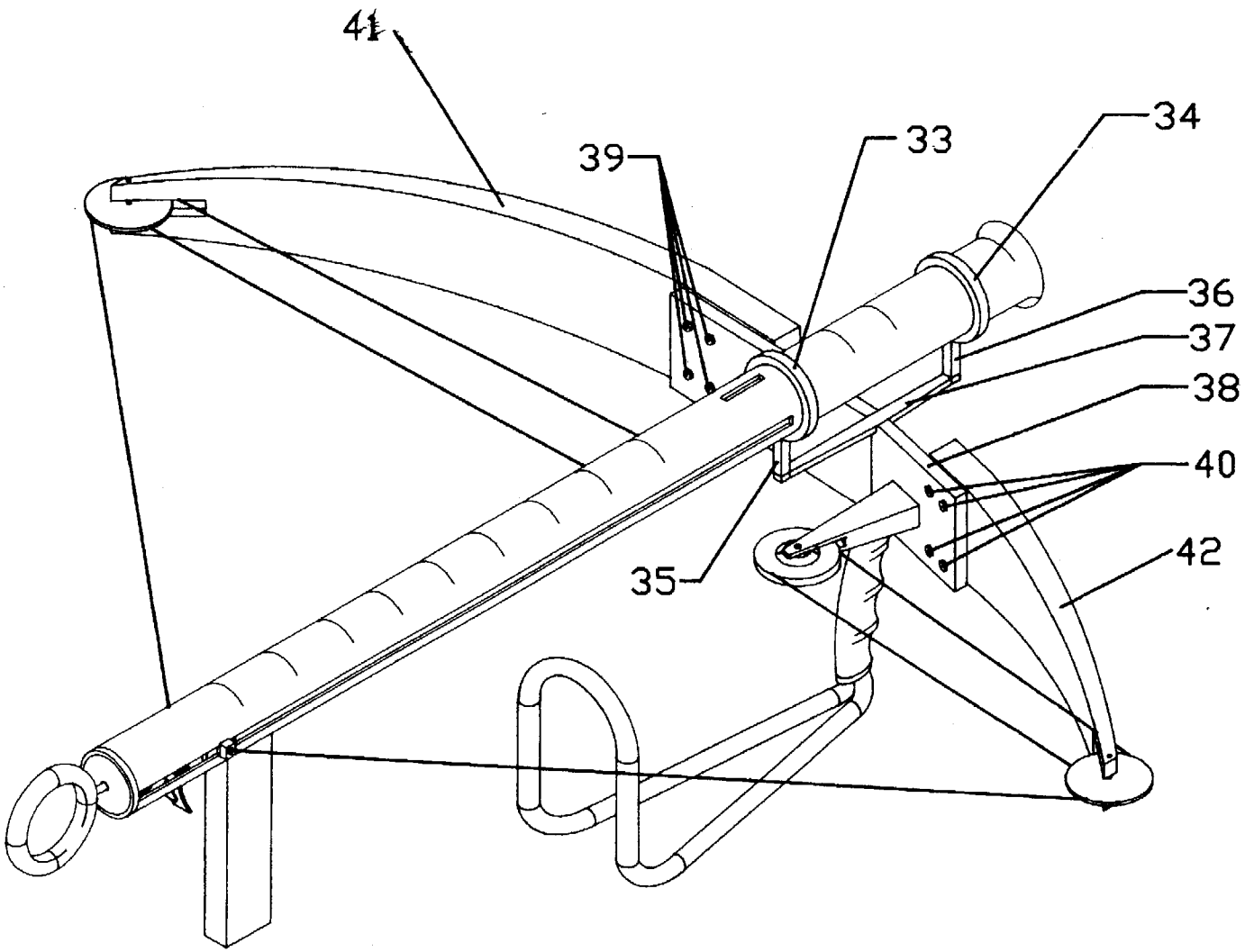
FIG. 2 is an alternate embodiment of the invention of FIG. 1.

The rigid support 1 defines an opening which may be filled with an attachment block 6 or brace 37 as shown in FIG. 2. A first elongate energy storage means in the form of a first bow arm 7 has a first end attached to the block 6. The bow arm has a second end which is opposite the first end. A corresponding second elongate energy storage means 8, preferably in the form of a second bow arm 8, has a first end attached to the block 6 and a second end opposite the first end.

The bow arms 7 and 8 fit within grooves formed by the block 6 and are secured to the rigid arms 2 and 3 respectively by bolts 9 and 10 which pass through the block 6 and are secured by cooperating nuts (not shown).

A first attachment means in the form of a first pivot 12 is mounted in a space defined by the second end of the bow arm 7. A second attachment means 14 in the form of a second pivot 14 is similarly attached to the second end of the second bow arm 8. These attachment means or pivots 12 and 14 may receive a first end and a second end of a bow string 21 respectively as shown in FIG. 1 in any manner known in the art.

In the preferred embodiment, the attachment means are pivots 14 and 12 and receive cams 13 and 11 respectively. The cams are modified to allow the string 21 to slide over curved edges present on the cam walls. The curved or bevelled cams are added for this purpose.

The user launches a projectile inserted into a barrel means 5 attached by way of pocket or holding means 22. The barrel 5 moves through the openning in the block 6 when the user pulls back the bow string 21 using the holding means 22. The string is attached to a piston means shown generally in FIGS. 3 and 4.

Figure 3:
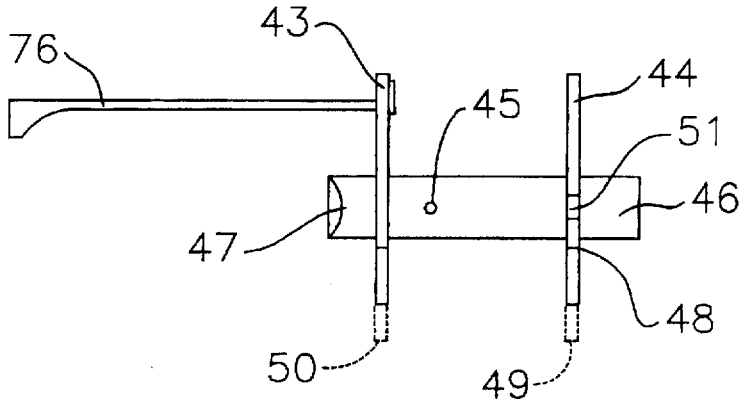
FIG. 3 is a side view of the piston.
Figure 4A:
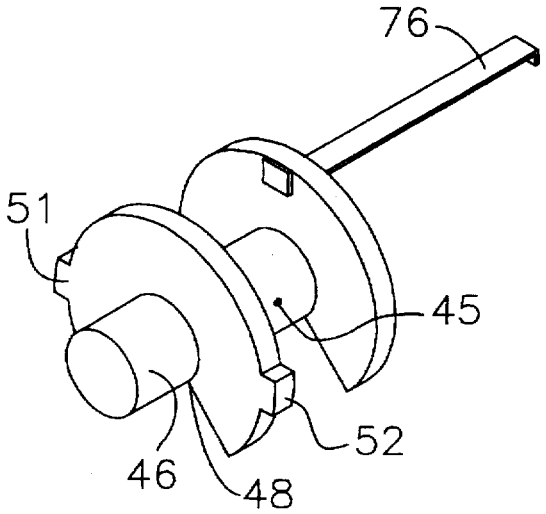
FIG. 4*a* is a plan view showing the arrangement of the piston mechanism from FIG. 3.
Figure 4B:
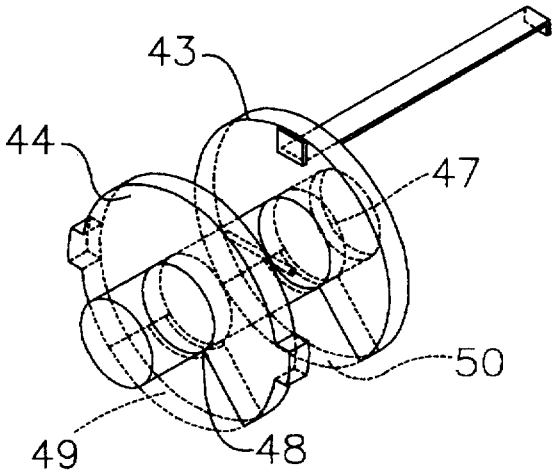
FIG. 4*b* is a transparent view of the piston shown in FIG. 4*a*.

FIGS. 3, 4*a* and 4*b* show the barrel means which comprises of a projectile launcher bolt 46 having an indentation 47 to receive the projectile on its front end. A first 43 and second 44 projectile guide are provided to give stability. These projectile guides have cut outs shown in FIG. 4 to allow easy movement over the internal features of the barrel. Slot guides 51 and 52 further provide stability to the arrangement. A hole 45 is provided in the bolt 46 to allow the string 21 to pass through the bolt. A projectile retaining spring 76 is provided to prevent the projectile 68 from falling out if the barrel is lowered. A holding notch 48 is provided in second guide 44 to hold a lip 61 in a ramp 60 shown in FIGS. 5 and 6.

Figure 5:
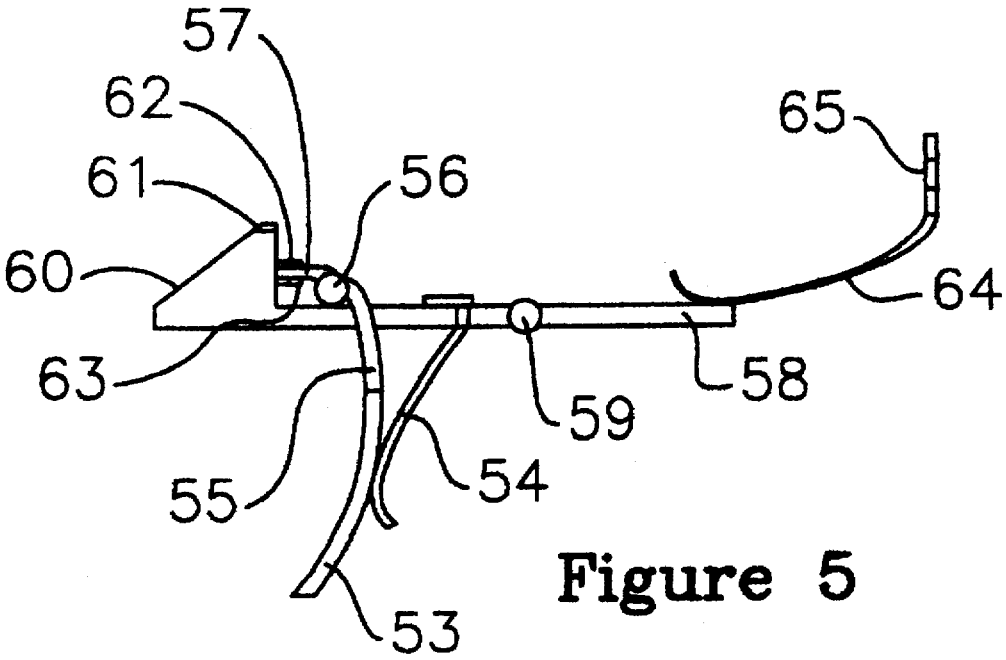
FIG. 5 is a side view of the trigger mechanism.
Figure 6:
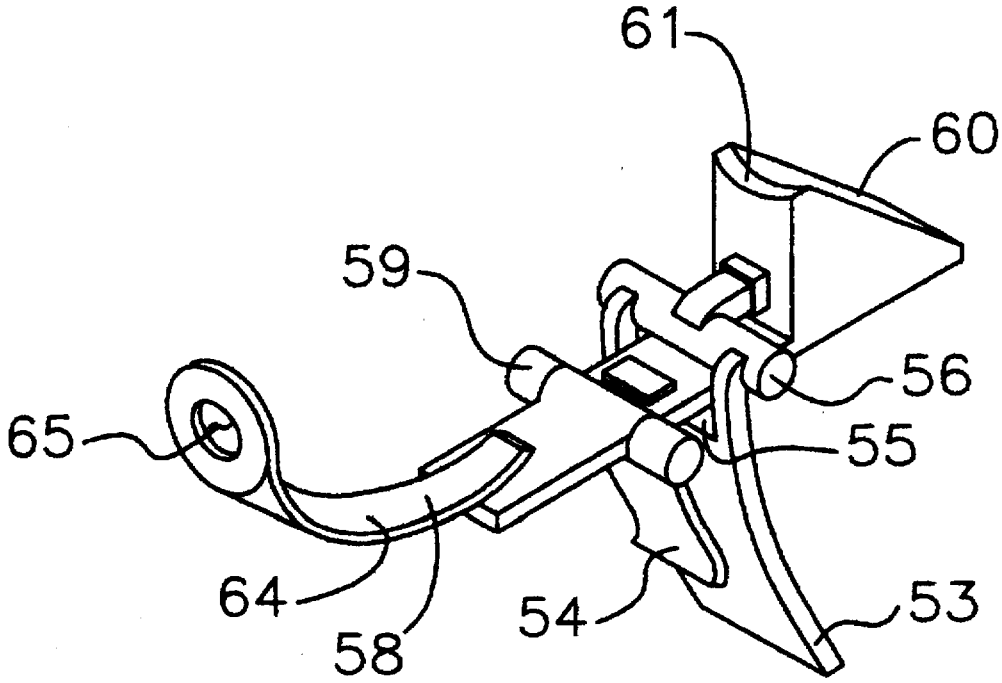
FIG. 6 is a plan view of the trigger mechanism of FIG. 5.

As shown in FIGS. 5 and 6 the trigger mechanism comprises a return spring 64 defining a hole 65 which is mounted to the back of the barrel 5 by a bolt through the hole 65. Return spring 64 is connected to projectile launcher release lever 58 and biases this lever. This lever 58 is mounted on a pivot 59. A trigger 58 pivots around pivot 56 and pushes notch 62 which is attached to ramp 60 through rotating the ramp 60 around pivot 59. When the user releases the trigger, the trigger is returned to place by spring 54 while spring 64 pushes the ramp 58 back into place. Notch 48 of the piston engages the front face 61, of ramp 60 and the mechanisms shown in FIG. 3 and 5 are joined until released by the user pulling trigger 53. The trigger 53 moves face 61 by having lever 57 of trigger 53 right within notch 62 which is, in turn attached to the face 61 of ramp 60.

Figure 7:
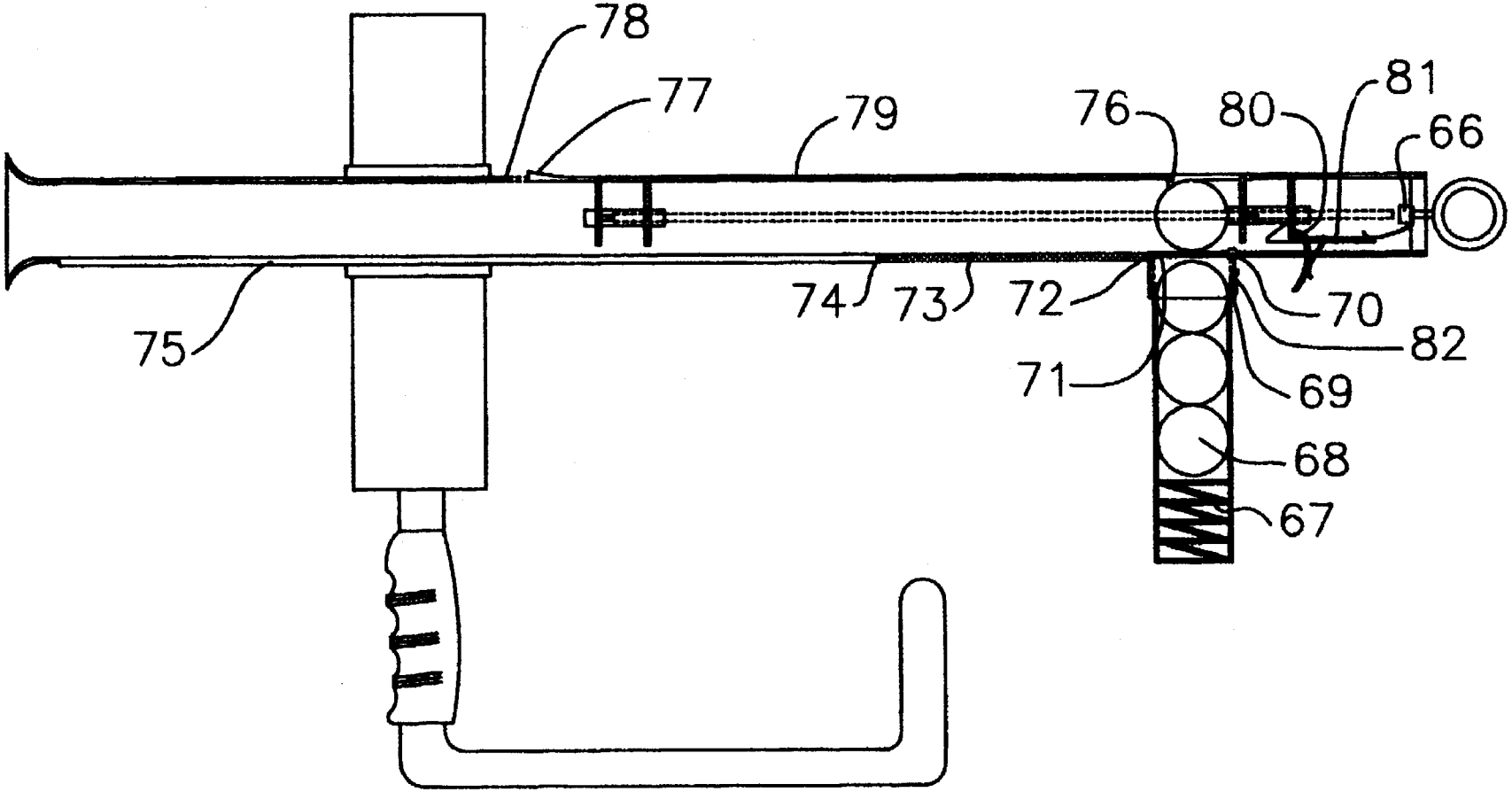
FIG. 7 is a cross sectional view of an embodiment of FIG. 1.
Figure 7A:
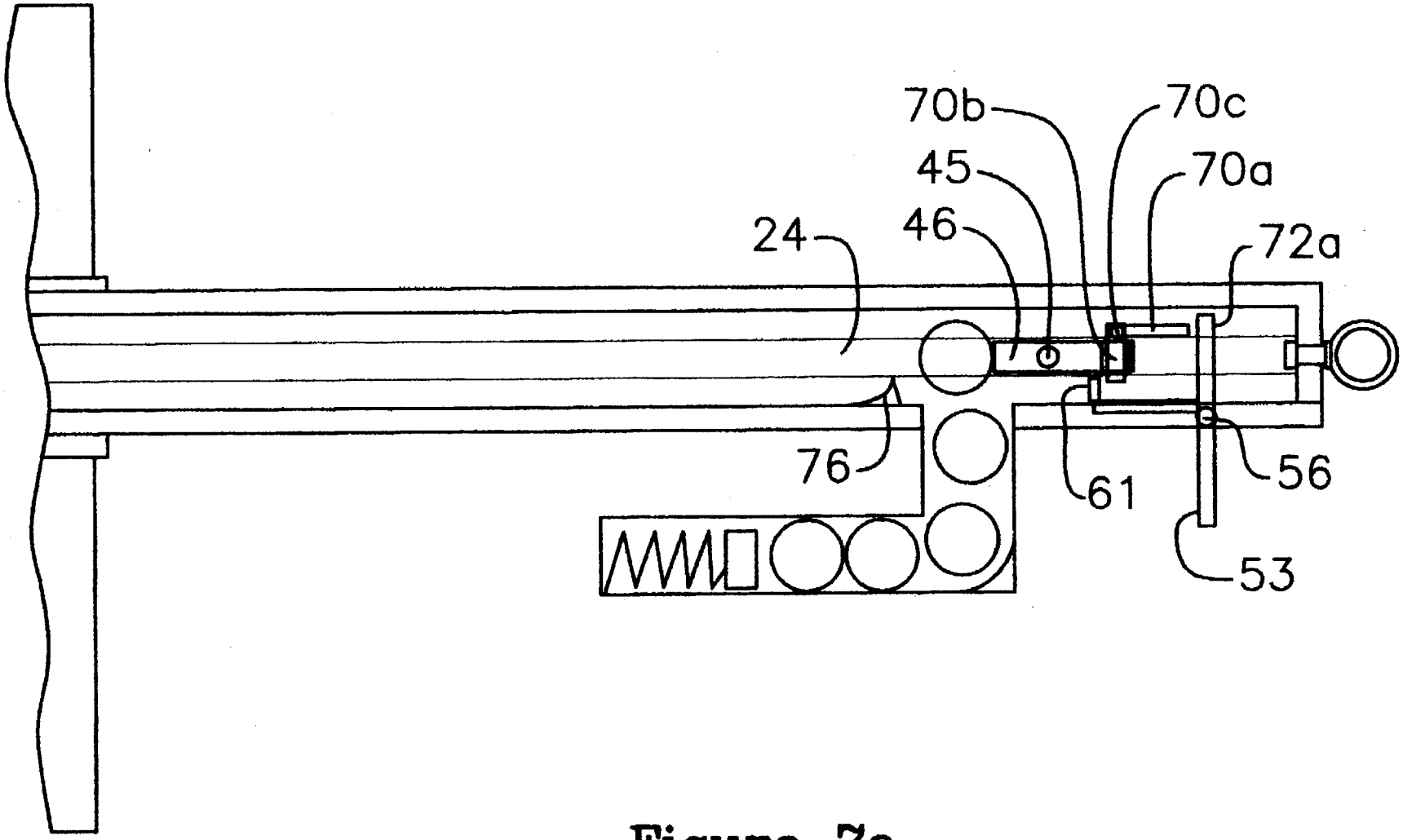
FIG. 7*a* is a cross sectional view of an alternate trigger and loading embodiment having an alternate mechanism of FIG. 1.
Figure 8:
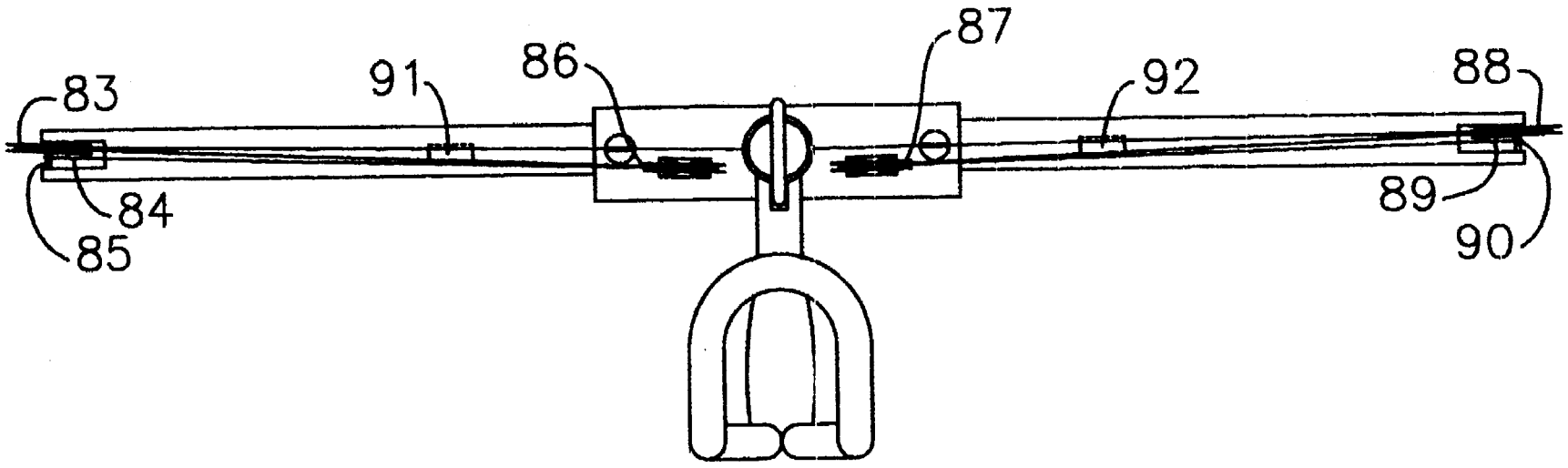
FIG. 8 is a rear view of the embodiment of FIG. 1.
Figure 9:
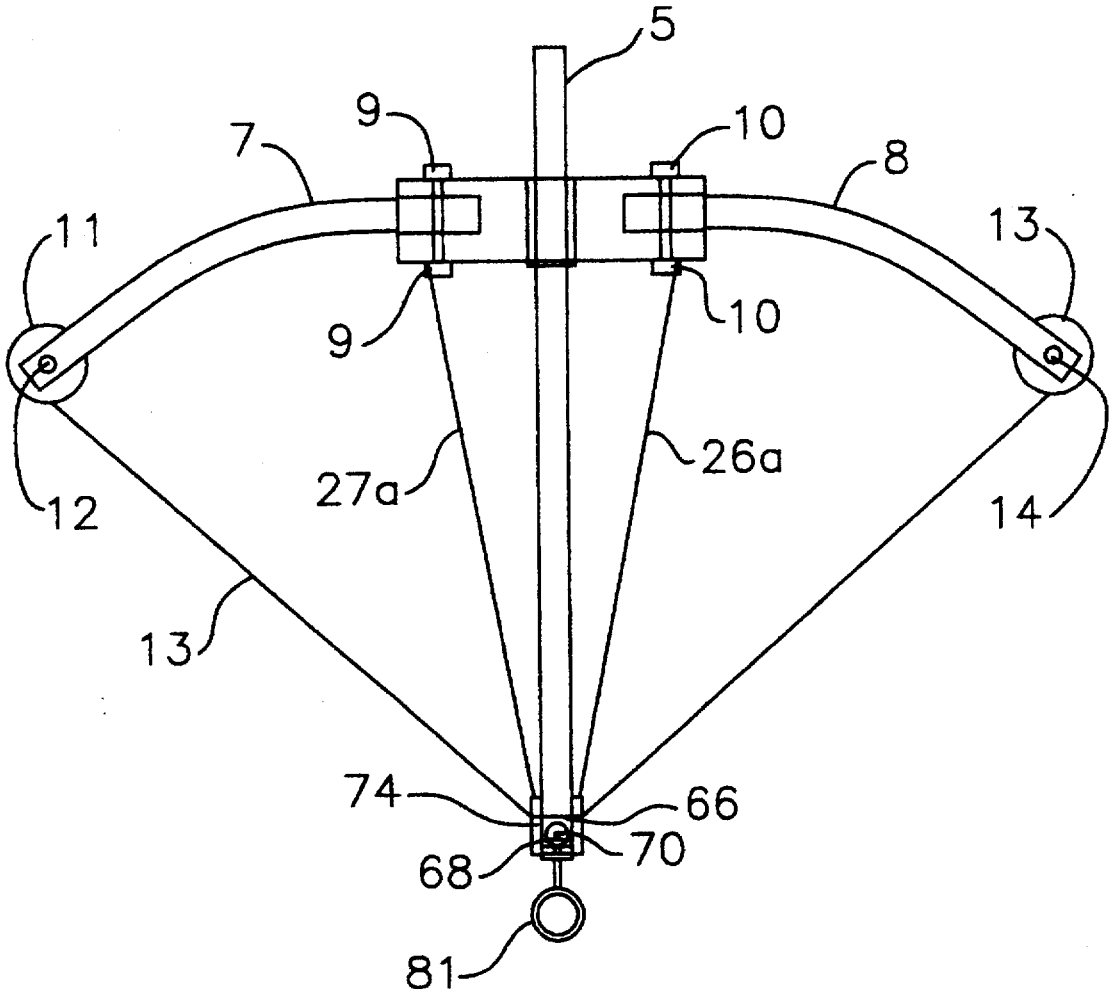
FIG. 9 is a cross sectional view of the embodiment of FIG. 7*a*.

FIG. 7*a* shows an alternative mechanism for the piston and trigger means shown in FIGS. 3–6. The projectile 68 is held within the chamber or open internal area formed by barrel 5 and is prevented by moving forward by a flexing notch 76. The string passes through grooves 24 defined by the barrel 5 to attach to piston or bolt 46 by passing through hole 45. Once in place, piston 46 is held in place by hammer 61 contacting leg 70*b* which fits through a leg hole in the piston or bolt 46. Leg 70*b* is mounted by pivot 70*c* to the barrel 5. As the piston moves back it hits leg 70*a* rotating leg 70*b* into the leg hole in the bolt. Trigger 53 is mounted by pivot 56 to the barrels. When the trigger is pulled back, the contact between leg 70*b* and 61 is broken and the barrel remains held in place while piston drives the projectile over notch 76 (which bends slightly to allow the projectile through) and out of the barrel. As the user slides the barrel 5 forward, the leg 70*a* is physically contacted by the rear of piston 46 forcing the leg 70*a* upward and leg 70*b* downward (as a result of the two turning around pivot 70*c*). A hole, now shown as 46*a*, in the piston 46 receives leg 70*b*. As the leg 70*b* moves down through the hole 46*a* it is locked in place by the contact between leg 70*b* at the bottom of leg 70*b* and the hammer or retaining bar 61. This contact between let 70*b* and hammer 61 is broken when the trigger 53 is pulled and the hammer rotates downward around pivot 56.

As can be seen, the barrel 5 has an ejection end 27 which has an aperture through which the projectile 68 exits. The projectile 68 may accelerate through the open internal area of the barrel along the longitudinal length of the barrel.

A hand grip 22 is held to barrel 5 at the back end 32 of the barrel 5 by bolt 66 which passes through the barrel 5 to be held by a nut. The grip 22 is used to pull back and hold the barrel. The projectile may be dropped into the front of barrel 5 or fed in any manner used for rifles. One embodiment shown in FIG. 7 allows for a continuous feed of ammunition pushed by spring 67 through magazine 29 into the barrel chamber.

Figure 10:
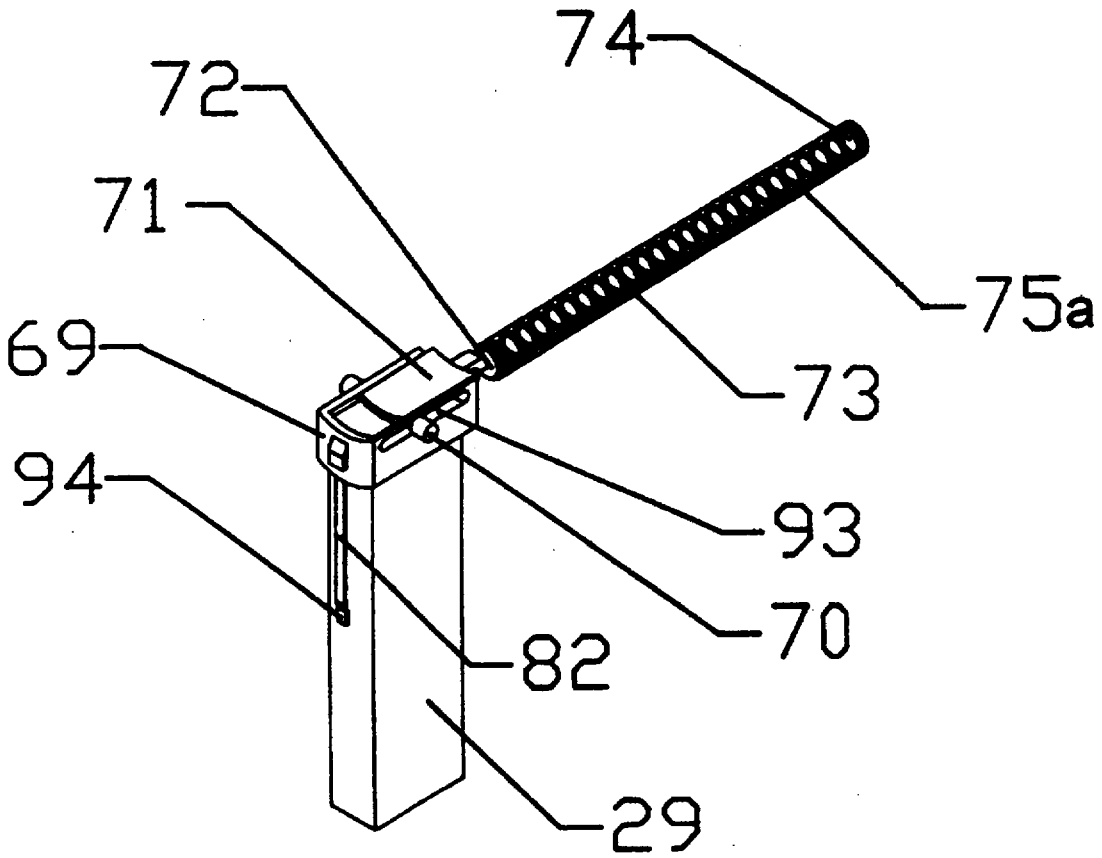
FIG. 10 shows a view of the loading mechanism of FIG. 1.
Figure 11:
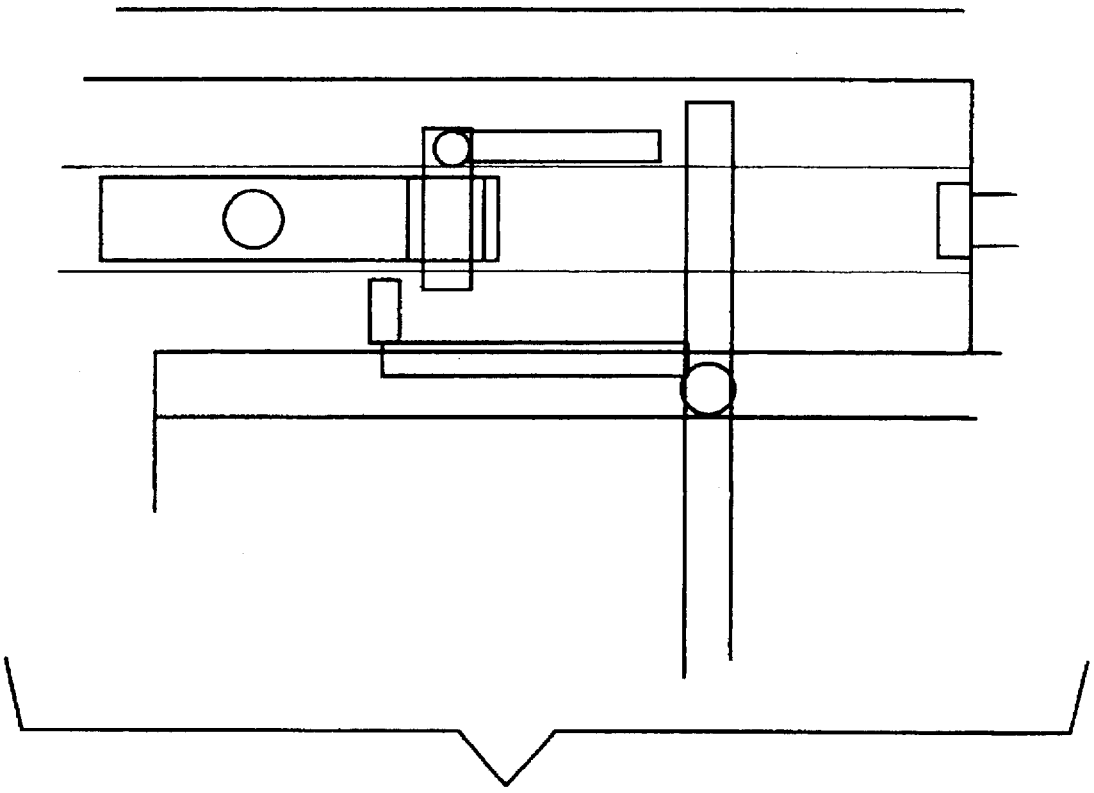
FIG. 11 is a close up of the trigger mechanism of FIG. 7*a*.

FIG. 10 is a detailed view of the mechanism to keep the additional projectiles from loading after one is in place. The lever 70 may be moved to allow a projectile into the barrel. Spring 74 in tube 75*a* then pushes plunger 72 to push cover 71 back over the magazine 29. The magazine attaches at point 69 by way of spring 82 held to the magazine at 94.

A widened front 27 portion of the barrel 5 may be provided to prevent the barrel 5 from moving all the way through opening in block 6.

This design provides that part of the middle of the bow string 21 travels approximately parallel to the opening in the block 6.

In one embodiment, shown in FIG. 2, a first support 33, a second support 34 through which the barrel 5 moves replaces block 6. Stands 35 and 36 mounted on rigid brace 37 keep the barrel on track. Under either embodiment, the rigid support 1 defines an opening which acts as a directional means holding a segment of the barrel 5 so as to substantially maintain the directional travel of the barrel 5 as it moves forward or back through the opening 26 defined in the rigid support 1 in response to the user pulling or pushing on the grip 22 which is attached to the rear 32 of the barrel 5 by a bolt 23. A sleeve 25 may be present within the opening 26 to guide the movement of the barrel 5.

Figure 2A:
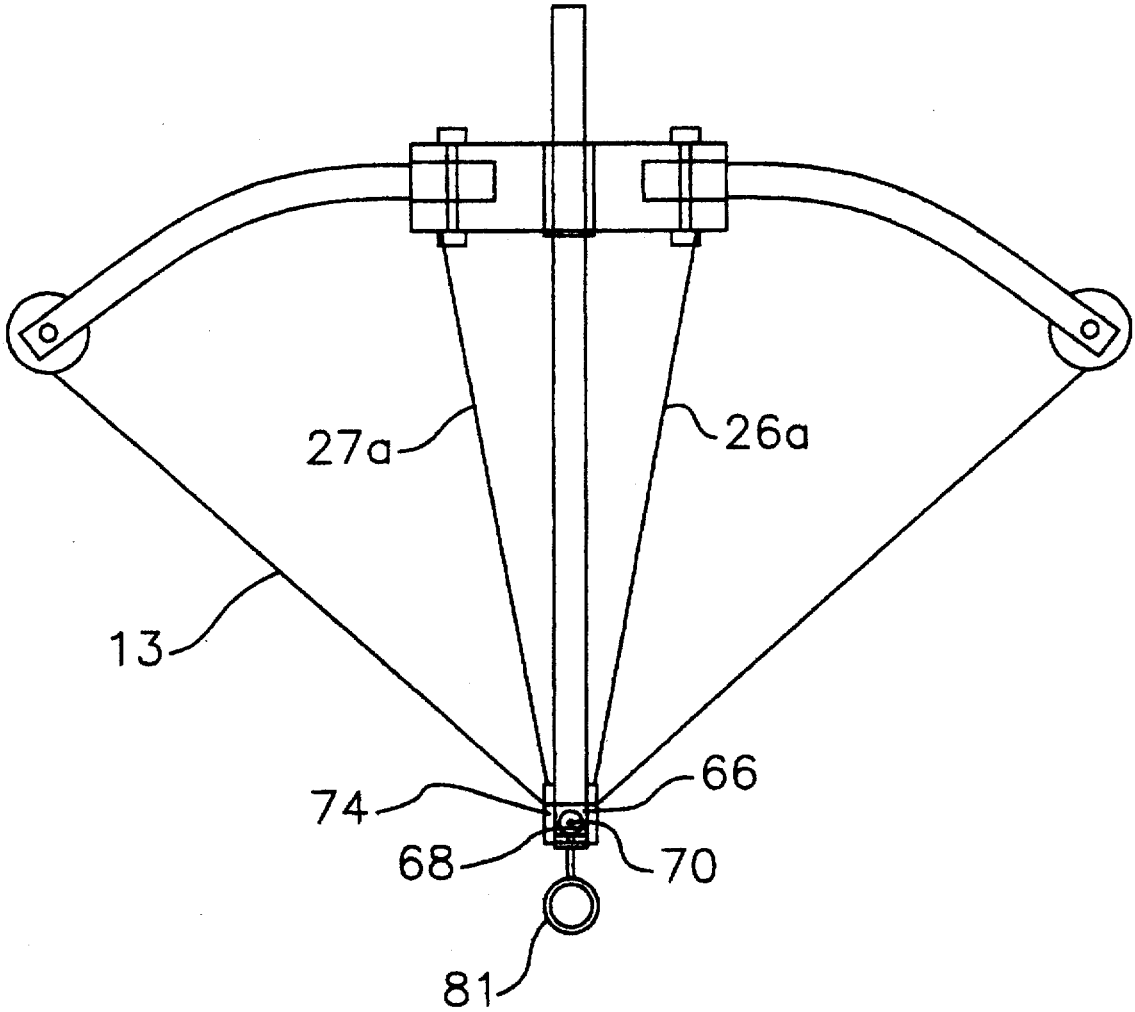
FIG. 2*a* is a view showing the arrangement of the curved cams from FIG. 1.

FIG. 2*a* shows an modification where a first elastic band member 26*a* and a second elastic member 27*a* are attached to the block 6 and run back to the piston 46. The elastic means 26*a* and 27*a* may be surgical tubing, BUNGEE cord or other suitable materials. These elastic means 26*a* and 27*a* are tensioned as the string moves away from the rigid support and pull the piston forward along the plane defined by the 3 points: the attachment part of elastic means 26*a* to the rigid support, the attachment point of 26*b* to the rigid support and the piston to which helps keep the string on the cams.

In the embodiment, shown in FIG. 1, the compounding apparatus comprises the first cam 11 rotatably mounted on the first pivot 12 whch serves as a first attachment means 12 and a first mounting means for receiving the first end of the bow string 21. On the opposite end of the invention, a second attachment means 14 is a second pivot 14 attached to the second bow arm, a second cam 13 rotatably mounted on the second pivot 14 said pivot receiving the second end of the bow string 21.

The bow string end 21 is attached to the first mounting means and passes operably over the second cam 13 on the second bow arm, string length 21 passes from the second cam to the first cam and finally string end is attached to the first mounting means 12 on the first bow arm. Mounting means may be formed by passing the ends of string 21 through holes in the pivots and then attaching these ends back to the position of the string 21 which did not pass through holes in the pivots with a clamp.

In the embodiment shown in FIG. 1 a second cam on each side of barrel 5 on the block 6 increases leverage. Each of these secondary cams 17 and 19 are on raised supports 15 and 16. First cam 17 is mounted on first cam pivot 18 and second cam 19 is mounted on pivot 20. In the preferred embodiment, these cam pivots are raised on cam supports 15 and 16 respectively to allow an adequate bending action.

In this embodiment the bow string 21 first end is secured and the string then passes through the center of first cam, in any manner known in the prior art, then, sequentially over the inner hub of the first cam, passes over the secondary cam and then back over the outer hub of the first cam, the string middle then passes through the bolt, then passes over the outer hub of the second cam, over second secondary cam, over the inner hub of second cam, through the center of the inner hub and is then secured to the center of the inner hub. This eliminates the need for the cable guard shown in normal compound bow arrangements.

Modified cams 17 and 19 are shown which have a central axis mounted on their respective pivots 12 and 14 which have at least one curved outer wall 17*a* and 19*a* respectively which curves away from the central axis of the cams 17 and 19.

Because many varying and different embodiments may be made within the scope of the inventive concept herein taught and because many modifications may be made in the embodiment(s) herein detailed by the descriptive requirements of the law, it is to be understood that the details herein are to be interpreted as illustrative and not in a limiting sense.

What I claim is:

1. An apparatus for hurling a projectile comprising:

(a) a barrel means for containing a projectile having an ejection end, a back end, and a longitudinal length comprised of consecutive segments between said ejection end and said back end, said barrel means defining an open internal area within said longitudinal length for containing the projectile and defining an aperture continuous with said open internal area at the ejection end;

(b) a substantially rigid support defining an opening through which the barrel means moves;

(c) a first bow arm having a first and second end wherein said first bow arm first end is connected to the rigid support means;

(d) a second bow arm having a first and second end wherein said second bow arm first end is connected to the rigid support;

(e) a first attachment means mounted substantially on the second end of the first bow arm and a second attachment means mounted substantially on the second end of the second bow arm;

(f) a bow string having a first end and second end and having a middle between the first and second end and having the first end attached to the first attachment means and having the second end attached to the second attachment means and further comprising a piston means movable within said barrel means attached to the string middle for moving the projectile in response to movement of the bow string relative to the rigid support and wherein said piston means is releasably connectable to the barrel by a trigger means mounted to the back end of the barrel means; and, wherein the opening defined by the rigid support being approximately equal to the circumference of the barrel means at the consecutive segments between the barrel back end and barrel ejection end so that at least some of the barrel segments may move along the barrel longitudinal length through the opening defined by the rigid support; and further comprising a sleeve within the opening for guiding consecutive segments of the barrel means within the sleeve.

2. An apparatus for hurling a projectile comprising:

(a) a barrel means for containing a projectile having an ejection end, a back end, and a longitudinal length comprised of consecutive segments between said ejection end and said back end, said barrel means defining an open internal area within said longitudinal length for containing the projectile and defining an aperture continuous with said open internal area at the ejection end;

(b) a substantially rigid support defining an opening through which the barrel means moves;

(c) a first bow arm having a first and second end wherein said first bow arm first end is connected to the rigid support means;

(d) a second bow arm having a first and second end wherein said second bow arm first end is connected to the rigid support;

(e) a first attachment means mounted substantially on the second end of the first bow arm and a second attachment means mounted substantially on the second end of the second bow arm;

(f) a bow string having a first end and second end and having a middle between the first and second end and having the first end attached to the first attachment means and having the second end attached to the second attachment means and further comprising a piston means movable within said barrel means attached to the string middle for moving the projectile in response to movement of the bow string relative to the rigid support and wherein said piston means is releasably connectable to the barrel by a trigger means mounted to the back end of the barrel means; and, wherein the opening defined by the rigid support being approximately equal to the circumference of the barrel means at the consecutive segments between the barrel back end and barrel ejection end so that at least some of the barrel consecutive segments may move along the barrel longitudinal length through the opening defined by the rigid support; and wherein the barrel means comprises at least one first groove defined by the longitudinal length of the barrel means, and wherein the piston means comprises a first end and a second end wherein the first end lies partially within the barrel and fits movably through said groove so that a portion of the piston may contact the projectile,; and further comprising at least one elastic band means for supplementing the elongate energy storage means having a first end and a second end and wherein the band first end is attached to the substantially rigid support and wherein the band second end is attached to the piston means.

3. The invention of claim 2 wherein the invention further comprises the rigid support defining a first half closest to the first bow arm, a second half closest to the second arm, and a second elastic band means having a first end and a second end and wherein the first elastic band means first end attaches to the rigid support on the half of the rigid support closest to the first bow arm and the second elastic band means first end attaches to the rigid support on the half of the rigid support closest to the second bow arm and the second end of each elastic band means attaches to the piston means for controlling the direction of travel of the bow string.

4. An apparatus for hurling a projectile comprising:

(a) a barrel means for containing a projectile having an ejection end, a back end, and a longitudinal length comprised of consecutive segments between said ejection end and said back end, said barrel means defining an open internal area within said longitudinal length for containing the projectile and defining an aperture continuous with said open internal area at the ejection end;

(b) a substantially rigid support defining an opening through which the barrel means moves;

(c) a first bow arm having a first and second end wherein said first bow arm first end is connected to the rigid support means;

(d) a second bow arm having a first and second end wherein said second bow arm first end is connected to the rigid support;

(e) a first attachment means mounted substantially on the second end of the first bow arm and a second attachment means mounted substantially on the second end of the second bow arm;

(f) a bow string having a first end and second end and having a middle between the first and second end and having the first end attached to the first attachment means and having the second end attached to the second attachment means and further comprising a piston means movable within said barrel means attached to the string middle for moving the projectile in response to movement of the bow string relative to the rigid support and wherein said piston means is releasably connectable to the barrel by a trigger means mounted to the back end of the barrel means; and, wherein the opening defined by the rigid support being approximately equal to the circumference of the barrel means at the segments between the barrel back end and barrel ejection end so that at least some of the barrel segments may move along the barrel longitudinal length through the opening defined by the rigid support; and wherein the piston further comprises a trigger receiving face and wherein the trigger means further comprises a return spring mounted to the back of the barrel means and wherein the return spring is connected to projectile launcher release lever and biases this lever upward in contact with the trigger receiving face between the rigid support and the piston receiving face and wherein the trigger further comprises a pivoting trigger which contacts the release lever so that as the trigger pivots it moves the release lever out of contact with the receiving face.

5. The invention of claim 4 wherein the piston means further comprises a piston hole defined by the piston means and wherein the trigger means further comprises a first leg having a front facing the rigid support is pivotally connected to the barrel so that it may fit within the piston hole and further comprising a hammer pivotally mounted on the barrel which contacts the front of the first leg so that when the hammer is rotate around its pivot, it releases the first leg so that the first leg may withdraw as the piston means moves forward.

* * * * *